US009361845B2

(12) United States Patent
Pyoun et al.

(10) Patent No.: US 9,361,845 B2
(45) Date of Patent: Jun. 7, 2016

(54) DISPLAY DEVICE COMPENSATING CLOCK SIGNAL WITH TEMPERATURE

(75) Inventors: Seoung-Bum Pyoun, Osan-si (KR); Seung-Hwan Moon, Yongin-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 0 days.

(21) Appl. No.: 11/060,797

(22) Filed: Feb. 18, 2005

(65) Prior Publication Data

US 2005/0184946 A1 Aug. 25, 2005

(30) Foreign Application Priority Data

Feb. 20, 2004 (KR) ..... 10-2004-0011303
Oct. 8, 2004 (KR) ..... 10-2004-0080538

(51) Int. Cl.
*G09G 3/36* (2006.01)

(52) U.S. Cl.
CPC ..... *G09G 3/3677* (2013.01); *G09G 3/3688* (2013.01); *G09G 2310/02* (2013.01); *G09G 2320/041* (2013.01)

(58) Field of Classification Search
USPC ..... 345/94, 97, 101, 204, 99; 349/37; 331/74
See application file for complete search history.

(56) References Cited

U.S. PATENT DOCUMENTS 4,008,440 A * 2/1977 Mizukoshi ..... 327/323
4,923,285 A * 5/1990 Ogino et al. ..... 345/101
5,684,503 A * 11/1997 Nomura et al. ..... 345/97
5,936,603 A * 8/1999 Lippmann et al. ..... 345/101
7,071,929 B2 * 7/2006 Fujii ..... 345/204
7,385,598 B2 * 6/2008 Jung et al. ..... 345/204
2003/0098749 A1 * 5/2003 Terasawa et al. ..... 331/74
2003/0231735 A1 12/2003 Moon et al.
2004/0046729 A1 * 3/2004 Moon ..... 345/100
2004/0165692 A1 * 8/2004 Moon et al. ..... 377/64
2005/0162363 A1 * 7/2005 Kim ..... 345/92

FOREIGN PATENT DOCUMENTS

JP 04-096267 A 3/1992
JP 05-241128 A 9/1993
JP 10-031204 A 2/1998

(Continued)

OTHER PUBLICATIONS

U.S. Appl. No. 11/000,497—BPAI Decision on May 7, 2009.*

*Primary Examiner* — Ram Mistry
(74) *Attorney, Agent, or Firm* — Cantor Colburn LLP

(57) ABSTRACT

A display device for improving display quality includes a pulse compensator, a gate driver, a source driver and a display panel. The pulse compensator generates a clock signal of which amplitude decreases when peripheral temperature increases and increases when peripheral temperature decreases. The gate driver outputs a gate driving signal to the display panel based on the clock signal, wherein an amplitude of the gate driving signal decreases when the peripheral temperature increases and the amplitude of the gate driving signal increases when the peripheral temperature decreases. The source driver provides a gray-scale voltage based on gray-scale data, and the display panel displays an image corresponding to the gray-scale voltage in response to the gate driving signal. Therefore, the deterioration in the drive capability of the gate driver depending on the peripheral temperature may be prevented and display quality of the display device may be improved.

18 Claims, 11 Drawing Sheets

(56) References Cited

FOREIGN PATENT DOCUMENTS

| | | | |
|---|---|---|---|
| JP | 2001-228836 | A | 8/2001 |
| JP | 2002-169139 | A | 6/2002 |
| JP | 2003-255304 | A | 9/2003 |
| JP | 2004-103226 | A | 4/2004 |
| TW | 335473 | | 7/1998 |

* cited by examiner

DISPLAY DEVICE COMPENSATING CLOCK SIGNAL WITH TEMPERATURE

CROSS-REFERENCE OF RELATED APPLICATIONS

The present application claims priority from Korean Patent Application No. 2004-11303, filed on Feb. 20, 2004, and Korean Patent Application No. 2004-80538, filed on Oct. 8, 2004, the disclosure of which is hereby incorporated herein by reference in their entirety.

BACKGROUND OF THE INVENTION

1. Field of the Invention

The present invention relates to a display device and a method of driving the display device.

2. Description of the Related Art

In general, a liquid crystal display (LCD) device includes an LCD panel having a plurality of gate and data lines, a gate driver circuit for outputting gate driving signals to the gate lines, and a data driver circuit for outputting image signals (or gray scale voltages) to the data lines. The gate and data driver circuits implemented by an integrated circuit (IC) are mounted on the LCD panel.

In recent, the gate driver circuit implemented by the IC is not mounted on the liquid crystal display panel, however, the gate driver circuit integrated in a peripheral region of the LCD panel has been developed so as to reduce a total size of the LCD device and to increase productivity.

In a structure of the gate driver circuit integrated on the LCD panel, the gate driver circuit includes a shift register having a plurality of cascaded stages. In addition, each of the stages includes a plurality of thin film transistors (TFT) and capacitors that generate gate driving signals for driving gate lines.

Drive capability of the TFTs depends on peripheral temperature, particularly, the drive capability of the TFTs decreases when the peripheral temperature decreases because a gate voltage (Vg) of each of the TFTs decreases when the peripheral temperature decreases.

That is, a liquid crystal capacitor coupled to the respective gate lines may be not fully charged when the gate voltage (Vg) of the TFTs decreases, as a result, display quality of the LCD device may be deteriorated.

BRIEF SUMMARY OF THE INVENTION

The present invention provides a display device for improving display quality by enhancing drive capability of a gate driver.

The present invention also provides a method of driving a display device for improving display quality by enhancing drive capability of a gate driver.

The present invention also provides a pulse compensator for generating a pulse of which amplitude increases in case peripheral temperature decreases.

A display device according to one exemplary embodiment of the present invention includes a display panel, a pulse compensator, a source driver and a gate driver. The pulse compensator generates a clock signal, wherein an amplitude of the clock signal decreases when peripheral temperature increases and the amplitude of the clock signal increases when peripheral temperature decreases. The gate driver outputs gate driving signals based on the clock signals, wherein an amplitude of the gate driving signal decreases when peripheral temperature increases and the amplitude of the gate driving signal increases when peripheral temperature decreases. The source driver provides a gray-scale voltage based on gray-scale data of an image. The display panel displays the image corresponding to the gray-scale voltage in response to the gate driving signals.

A method of driving an image display device according to another exemplary embodiment of the present invention includes converting a first pulse into a clock signal, wherein an amplitude of the clock signal decreases when peripheral temperature increases and the amplitude of the clock signal increases when peripheral temperature decreases; providing gate driving signals to the plurality of gate lines based on the clock signal, wherein an amplitude of the gate driving signal decreases when peripheral temperature increases and the amplitude of the gate driving signal increases when peripheral temperature decreases; and displaying an image corresponding to a gray-scale voltage in response to the gate driving signals.

A pulse compensator according to another exemplary embodiment of the present invention includes a first voltage generator, a second voltage generator and a switching circuit. The first voltage generator receives a first pulse and outputs a first voltage signal having a voltage level higher than that of the first pulse by a first reference voltage when peripheral temperature becomes lower than a reference temperature. The second voltage generator outputs a second voltage signal having a voltage level lower than that of the first pulse by a second reference voltage. The switching circuit is coupled to the first and second voltage generators, and generates the clock signal swinging between a first DC voltage and a second DC voltage.

According to the display device, although peripheral temperature becomes lower than the reference temperature, by increasing the amplitude of the clock signal provided from the gate driver, the deterioration of the drive capability of the gate driver depending on the peripheral temperature may be prevented.

BRIEF DESCRIPTION OF THE DRAWINGS

The above and other advantages of the present invention will become more apparent by describing in detail exemplary embodiments thereof with reference to the accompanying drawings, in which.

DESCRIPTION OF THE EXEMPLARY EMBODIMENTS

It should be understood that the exemplary embodiments of the present invention described below may be varied modified in many different ways without departing from the inventive principles disclosed herein, and the scope of the present invention is therefore not limited to these particular following embodiments. Rather, these embodiments are provided so that this disclosure will be through and complete, and will fully convey the concept of the invention to those skilled in the art by way of example and not of limitation.

Hereinafter, the present invention will be described in detail with reference to the accompanying drawings.

Figure 1:
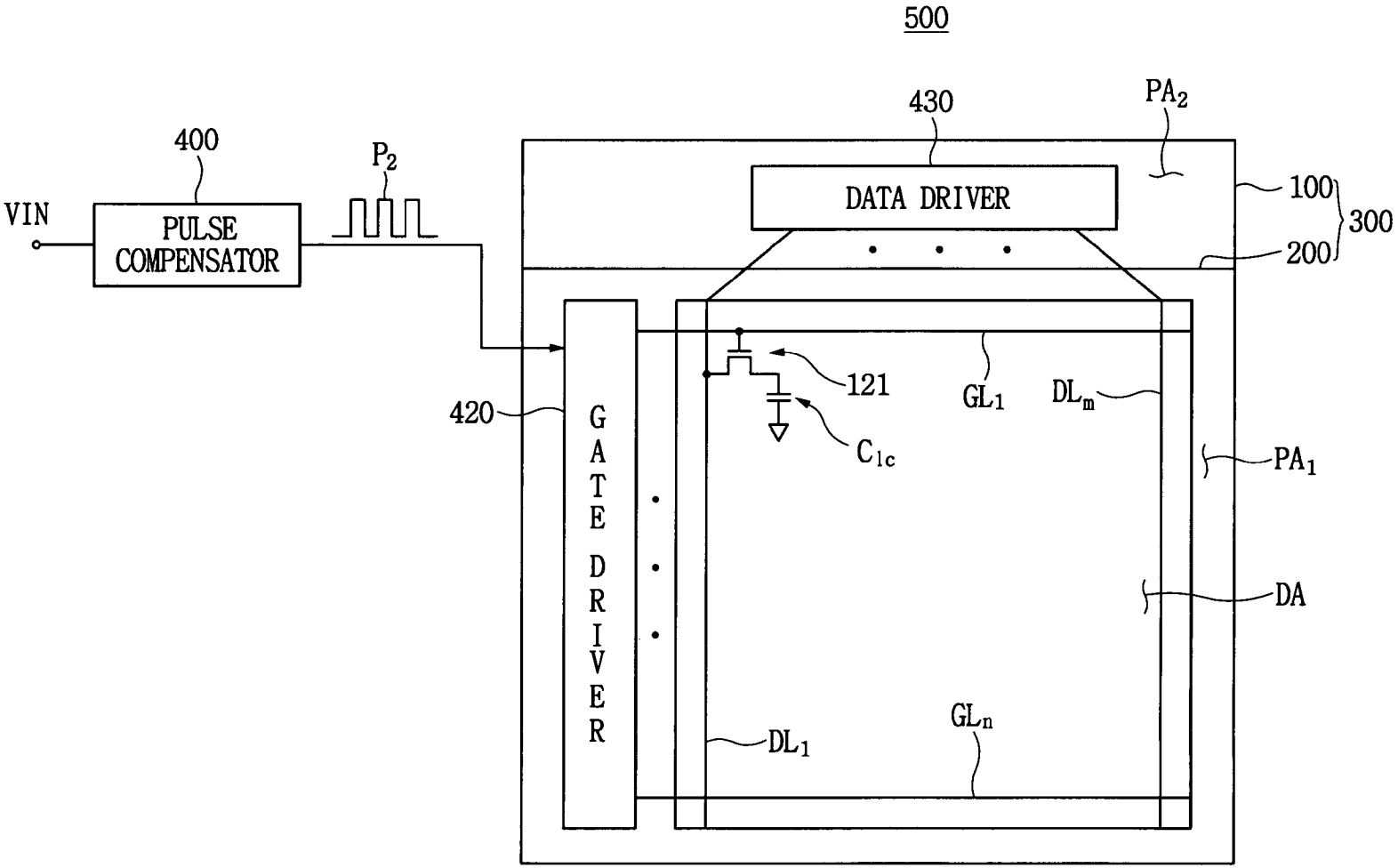
FIG. 1 is a block diagram illustrating a liquid crystal display (LCD) device according to an exemplary embodiment of the present invention.

FIG. 1 is a block diagram illustrating a liquid crystal display (LCD) device according to an exemplary embodiment of the present invention.

Referring to FIG. 1, a liquid crystal display (LCD) device 500 according to an exemplary embodiment of the present invention includes an LCD panel 300, a gate driver 420, a data driver (or source driver; 430) and a pulse compensator 400.

The liquid crystal display panel 300 includes a display region DA for displaying images, a first peripheral region PA1 adjacent to the display region DA and a second peripheral region PA2 adjacent to the first peripheral region PA1.

The display region DA includes a plurality of gate lines GL1~GLn and a plurality of data lines DL1~DLm.

The gate lines are extended in a first direction (Dr1), and the data lines are extended in a second direction (Dr2) perpendicular to the first direction (Dr1).

In addition, the display region DA includes a plurality of pixels, each of which includes a TFT 121 and a liquid crystal capacitor Clc.

In detail, a gate electrode of the TFT 121 is coupled to the first gate line GL1, a source electrode of the TFT 121 is coupled to the first data line DL1, and a drain electrode of the TFT 121 is coupled to the liquid crystal capacitor Clc.

The first peripheral region PA1 encloses the display region DA.

The second peripheral region PA2 is adjacent to the first peripheral region PA1. The second peripheral region PA2 is formed in a region of a lower plate 100 that is disposed peripheral to an upper plate 200.

The data driver 430 is mounted on the lower plate 100 in the second peripheral region PA2. The data driver 430 is electrically connected to the data lines DL1~DLm and outputs data signals (or gray scale voltages) to the data lines DL1~DLm.

The first peripheral region PA1 includes the gate driver 420. The gate driver 420 is electrically connected to the gate lines GL1~GLn and sequentially outputs gate signals to the gate lines GL1~GLn.

Figure 2:
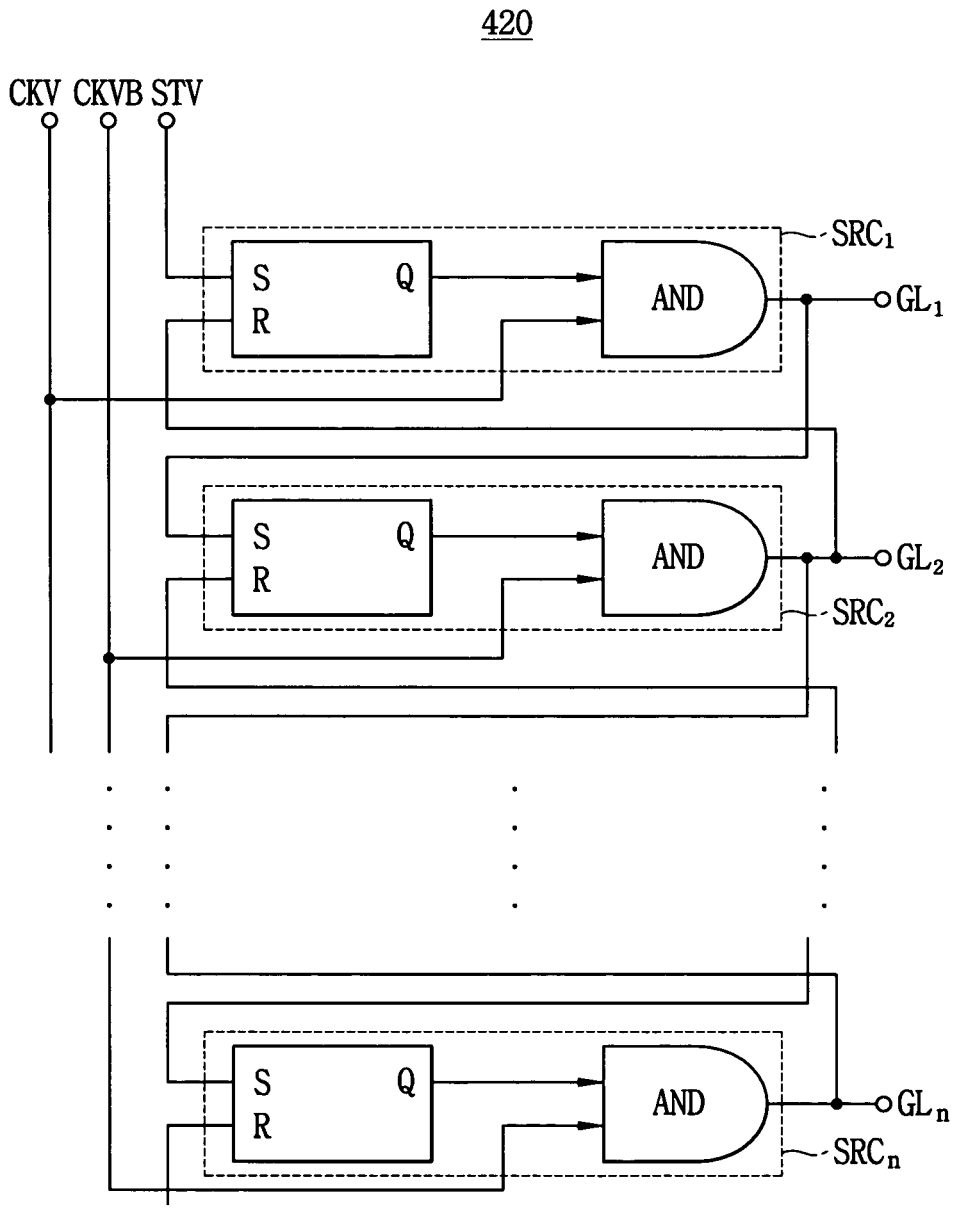
FIG. 2 is a schematic diagram illustrating the gate driver shown in FIG. 1.

FIG. 2 is a schematic diagram illustrating the gate driver shown in FIG. 1.

Referring to FIG. 2, the gate driver 420 includes a shift register having a plurality of cascaded stages SRC1~SRCn.

Each of the stages of the shift register includes a S-R latch and an AND gate.

The S-R latch is set by an output signal of previous stage, and is reset by an output signal of next stage.

The AND gate of each of the stages generates gate signals OUT1~OUTn when the S-R latch is set and a first or a second clock (CKV, CKVB) has a high voltage level.

Odd numbered stages SRC1, SRC3, SRC5, . . . receive the first clock CKV, and even numbered stages SRC2, SRC4, SRC6, . . . receive the second clock CKVB having an inverted phase with respect to the first clock CKV.

Accordingly, AND gates of the odd numbered stages SRC1, SRC3, SRC5, . . . generate gate signals OUT1, OUT3, OUT5, . . . when the S-R latch is set and the first clock CKV has a high voltage level.

AND gates of the even numbered stages SRC2, SRC4, SRC6, . . . generate gate signals OUT2, OUT4, OUT6, . . . when the S-R latch is set and the second clock CKVB has a high voltage level.

Therefore, the gate driver 420 sequentially outputs the first or the second clock (CKV, CKVB) having a high voltage level as gate signals OUT1~OUTn to the plurality of gate lines GL1~GLn.

Figure 3:
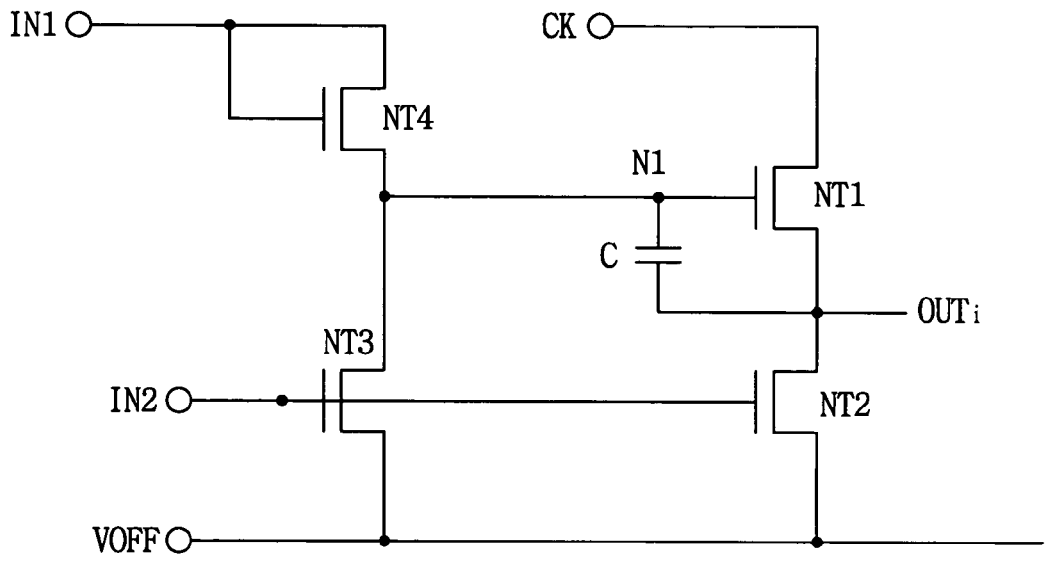
FIG. 3 is a circuit diagram illustrating each of the stages of the gate driver shown in FIG. 2.
Figure 4:
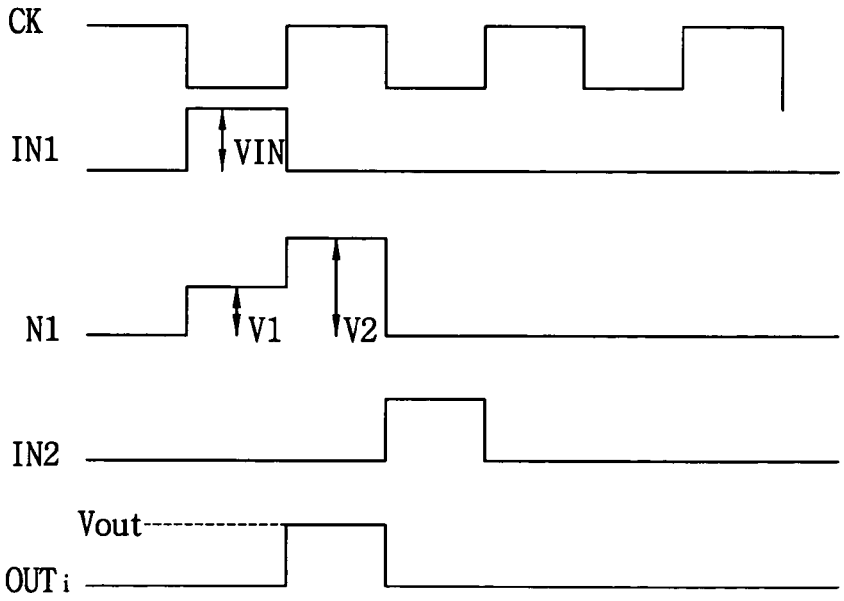
FIG. 4 is a timing diagram illustrating an operation of each of the stages shown in FIG. 3.

FIG. 3 is a circuit diagram illustrating each of the stages of the gate driver shown in FIG. 2 and FIG. 4 is a timing diagram illustrating an operation of each of the stages shown in FIG. 3.

Referring to FIG. 3, each of the stages includes a plurality of NMOS thin film transistors NT1, NT2, NT3 and NT4 and a capacitor C.

A first input terminal IN1 of a first stage receives a starting signal STV, and first input terminals of other stages except the first stage receive a gate signal of a previous stage.

A second input terminal IN2 receives a gate signal of a next stage.

A clock input terminal CK receives the clock signal CKV or CKVB.

The capacitor C is charged with electric charges after a gate signal of the previous stage inputted to the input terminal IN1 passes through the diode-coupled transistor NT4. A node N1 is charged with a voltage V1 (V1=VIN1−Vth, Vth is a threshold voltage of a transistor NT4).

When the capacitor C is charged with the electric charges and the clock signal CK of a high voltage level is provided to a drain of transistor NT1, the transistor NT1 is turned-on and the clock signal CK or CKB is outputted as a gate signal OUTi.

When a gate signal OUTi is outputted, a node N1 is bootstrapped by the capacitor C to be raised to a voltage V2 (V2=V1+VOUTi), as a result, the clock signal CK may be sufficiently transferred to a gate line by maintaining the turn-on state of the transistor NT1. Therefore, a gate voltage of the thin film transistor NT1 has the voltage V2.

The thin film transistor NT1 drives gate lines having parasitic capacitance of hundreds of pF.

When a gate signal $OUT_{i+1}$ of the next stage is inputted to the second input terminal IN2, a transistor NT3 is turned-on to discharge the charged voltage of the capacitor C, and a transistor NT2 is turned-on to pull-down the gate signal OUTi to a first power supply voltage level VGOFF. For example, the clock signal CK has a voltage level more than or equal to +15 volts and the first power supply voltage VGOFF has a voltage level less than or equal to −7 volts. In addition, each of the transistors NT1, NT2, NT3 and NT4 includes a-Si TFT.

Figure 5:
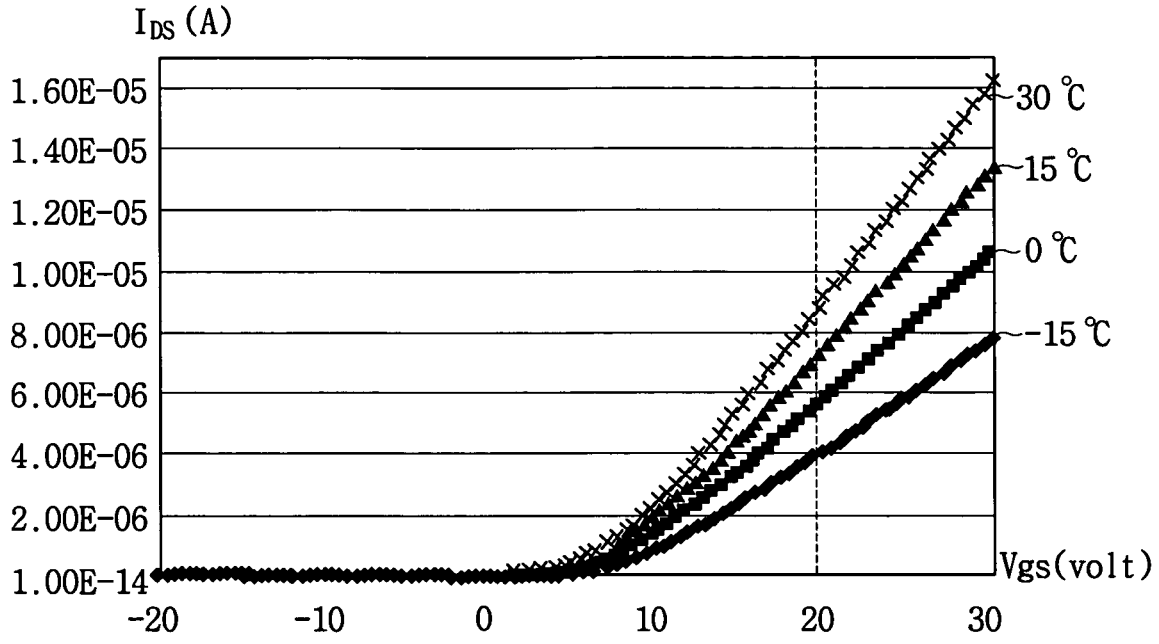
FIG. 5 is a graph illustrating gate-to-source voltages (Vg) and drain-to-source current (IDS) of an a-Si TFT depending on peripheral temperature.

FIG. 5 is a graph illustrating gate-to-source voltages Vg and drain-to-source current IDS of an a-Si TFT depending on peripheral temperature.

Particularly, FIG. 5 is a graph illustrating gate-to-source voltages Vg and drain-to-source currents $I_{DS}$ of the transistor NT1 shown in FIG. 3 for driving the gate lines.

Referring to FIG. 5, the current drive capability of the transistor NT1 tested in a condition of a low peripheral temperature (about −15° C.) has a half level compared with the current drive capability of the transistor NT1 tested in the condition of a room temperature.

Although the parasitic capacitance of a gate line hardly depends on the peripheral temperature, the quantity of the electric charges for charging the parasitic capacitor of a gate line may be decreased for a predetermined time period when the current drive capability of the transistor NT1 is lowered in condition of a low peripheral temperature.

Accordingly, a gate driving voltage for driving a gate of the thin film transistor (TFT) 121 in a pixel may be lowered. Therefore, the gate signals, i.e. the driving voltages, of each of the stages may be not generated because the lowered gate driving voltage is outputted to a following input terminal IN1 of the shift register.

Referring back to FIG. 1, the pulse compensator 400 increases and decreases amplitude of the first or the second clock (CKV, CKVB as shown in FIG. 2) provided to the transistor NT1 of each of the stages based on variation of the peripheral temperature.

That is, the pulse compensator 400 increases the amplitude of the first or the second clock (CKV, CKVB) when the peripheral temperature decreases, and decreases the amplitude of the first or the second clock (CKV, CKVB) when the peripheral temperature increases.

As a result, the voltage difference between the source and the gate of the TFT in a pixel in the liquid crystal display panel 300 may be increased, therefore, the drive capability of the TFT in a pixel may be improved due to the increased voltage difference.

In detail, the pulse compensator 400 receives a DC voltage VIN to generate a first pulse P1, and converts the first pulse P1 into a second pulse P2 so that the second pulse P2 may swing in a more wide range than the first pulse P1 when the peripheral temperature decreases. The second pulse P2 outputted from the pulse compensator 400 is provided to the gate driver 420. For example, the second pulse P2 may be the first or the second clock (CKV, CKVB).

Figure 6:
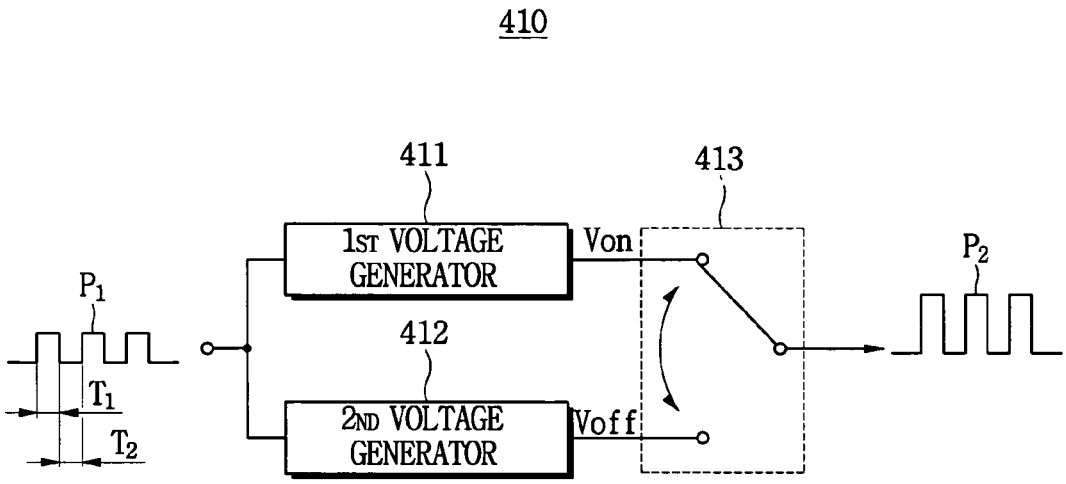
FIG. 6 is a block diagram illustrating a second pulse generator of the pulse compensator shown in FIG. 1.
Figure 7:
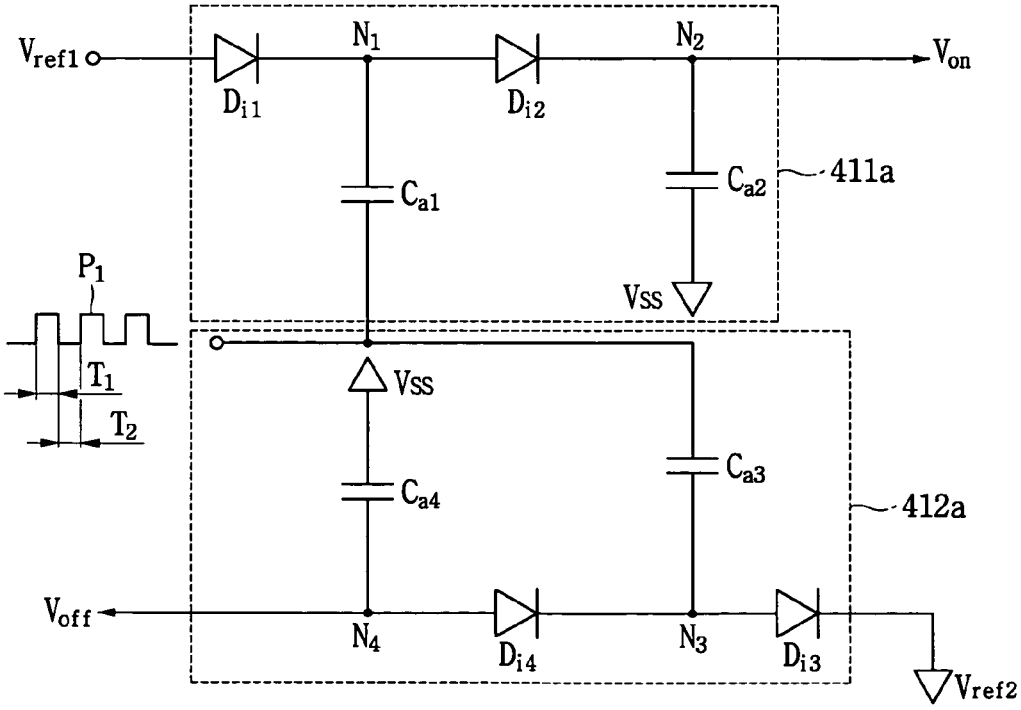
FIG. 7 is a circuit diagram illustrating the first and second voltage generators of FIG. 6 that are implemented as a charge pump circuit according to an exemplary embodiment of the present invention.
Figure 11:
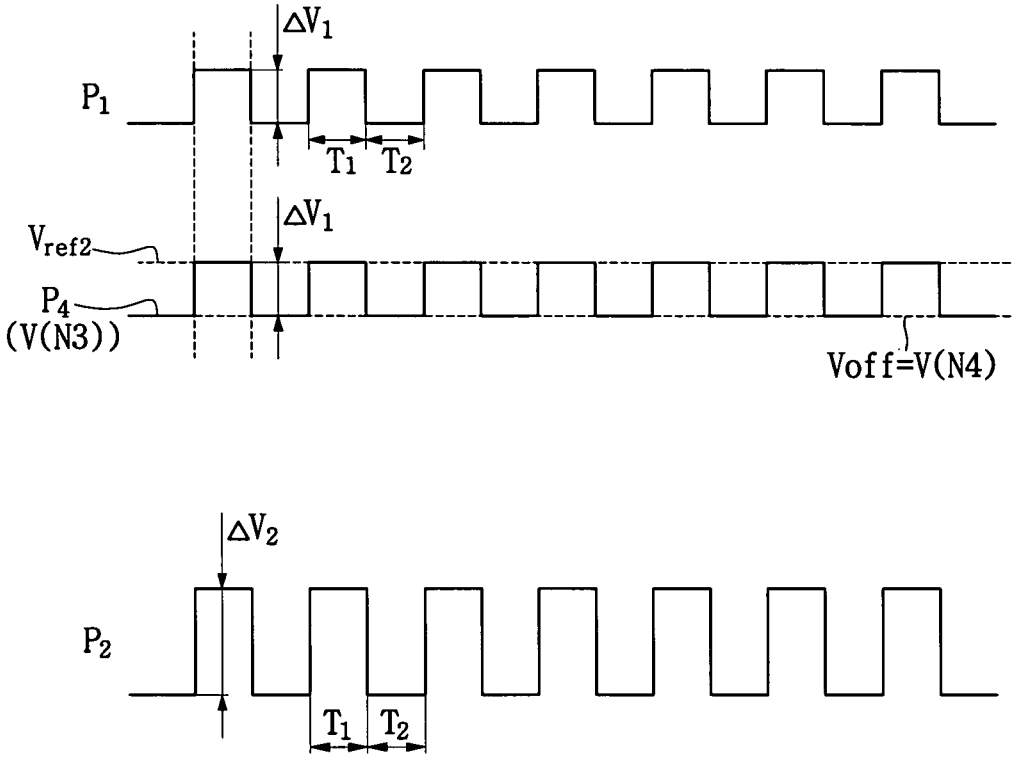
FIG. 11 is a timing diagram illustrating an operation of the circuit of FIG. 7.

FIG. 6 is a block diagram illustrating a second pulse generator of the pulse compensator shown in FIG. 1, FIG. 7 is a circuit diagram illustrating the first and second voltage generators of FIG. 6 that are implemented as a charge pump circuit according to an exemplary embodiment of the present invention, and FIG. 11 is a timing diagram illustrating an operation of the circuit in FIG. 7.

The pulse compensator 400 includes a PWM signal generator 910 (see FIG. 9.), a feedback circuit 920 (see FIG. 9.) and a second pulse generator 410.

Referring to FIG. 6, the second pulse generator 410 includes a first voltage generator 411, a second voltage generator 412 and a switching circuit 413.

The second pulse generator 410 outputs the second pulse P2 having a higher amplitude (ΔV2, see FIG. 11) than the amplitude (ΔV1, see FIG. 11.) of the first pulse P1 according to the peripheral temperature.

The switching circuit 413 switches between a gate turn-on voltage Von and a gate turn-off voltage Voff to generate the second pulse P2 that has a higher amplitude than that of the first pulse P1, and a period and a phase different from those of the first pulse P1.

The first voltage generator 411 receives a first reference voltage Vref1 having a predetermined DC voltage and the first pulse P1 to output the gate turn-on voltage Von having a voltage level higher than a high level of the first pulse P1 when the peripheral temperature becomes lower than the room temperature.

The second voltage generator 412 outputs the gate turn-off voltage Voff having a voltage level lower than a low level of the first pulse P1 when the peripheral temperature becomes lower than the room temperature.

In addition, as shown in FIG. 11, a first time period T1 indicates a time period during which the first pulse P1 is maintained at a high voltage level. A second time period T2 indicates a time period during which the second pulse P2 is maintained at a low voltage level.

The first reference voltage Vref1 is a predetermined DC voltage. For example, the first reference voltage Vref1 has about +8 volts.

The gate turn-on voltage Von and turn-off voltage Voff are a DC voltage. For example, the gate turn-on voltage Von has about +20 volts at the room temperature, and the gate turn-off voltage Voff has about −13 volts at the room temperature.

As shown in FIG. 7, the first voltage generator 411 includes a first charge pump circuit 411*a*. For example, the first charge pump circuit 411*a* includes a first diode Di1, a second diode Di2, a first capacitor Ca1 and a second capacitor Ca2.

The first charge pump circuit 411*a* may include at least three of combination of diodes and capacitors.

An anode of the first diode Di1 receives the first reference voltage Vref1 and a cathode of the first diode Di1 is coupled to a first node N1.

A first end of the first capacitor Ca1 is coupled to the first node N1 and a second end of the first capacitor Ca1 receives the first pulse P1.

An anode of the second diode Di2 is coupled to the first node N1 and a cathode of the second diode Di2 is coupled to a second node N2.

A first end of the second capacitor Ca2 is coupled to the second node N2 and a second end of the second capacitor Ca2 is coupled to Vss (Vss may have a ground or negative voltage). In addition, the gate turn-on voltage Von is outputted via the second node N2.

The first charge pump circuit 411*a* receives the first pulse P1 and the first reference voltage Vref1 to output a charge-pumped gate turn-on voltage Von.

The amplitude of the first pulse P1 decreases when the peripheral temperature increases, and the amplitude of the first pulse P1 increases when the peripheral temperature decreases.

In addition, the amplitude of the first reference voltage Vref1 decreases when the peripheral temperature increases, and the amplitude of the first reference voltage Vref1 increases when the peripheral temperature decreases.

As a result, a magnitude of the gate turn-on voltage Von decreases when the peripheral temperature increases, and the magnitude of the gate turn-on voltage Von increases when the peripheral temperature decreases.

A generation process of the first reference voltage Vref1 will be explained later.

Figure 9:
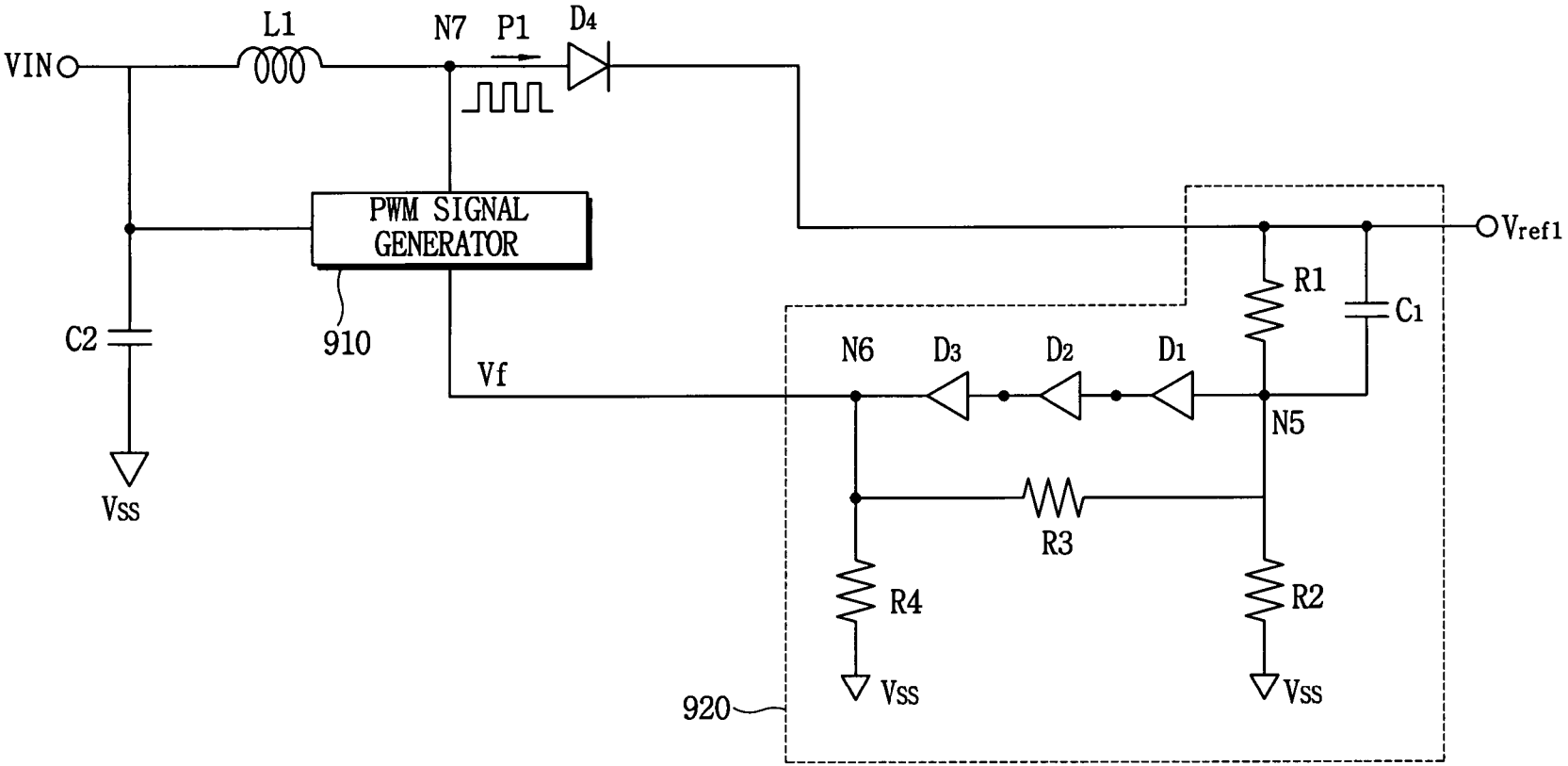
FIG. 9 is a circuit diagram illustrating a circuit for generating a first pulse (P1) based on variation of peripheral temperature.

As shown in FIGS. 7 and 9, when the first pulse P1 is provided to the first capacitor Ca1 of the first voltage generator 411, the first node N1 of the first capacitor Ca1 in the first voltage generator 411 outputs a third pulse P3. The third pulse P3 is higher than the first pulse P1 by the first reference voltage Vref. A voltage generated at the second node N2 is outputted as the gate turn-on voltage Von after the third pulse P3 is clamped by the second diode Di2 and the capacitor Ca2. In addition, the gate turn-on voltage Von is a DC voltage having a voltage level of (a high-level value of the first pulse (P1)+the first reference voltage (Vref1)−voltage drops at the first diode (Di1) and the second diode (Di2)).

The second voltage generator 412 includes a second charge pump circuit 412*a*. For example, the second charge pump circuit 412*a* includes a third diode Di3 and a fourth diode Di4, a third capacitor Ca3 and a fourth capacitor Ca4.

The second charge pump circuit 412*a* may include at least three of combination of diodes and capacitors.

A cathode of the third diode Di3 receives the second reference voltage Vref2, and an anode of the third diode Di3 is coupled to the third node N3.

A first end of the third capacitor Ca3 is coupled to the third node N3, and a second end of the third capacitor Ca3 receives the first pulse P1.

A cathode of the fourth diode Di4 is coupled to the third node N3, and an anode of the fourth diode Di4 is coupled to the fourth node N4.

A first end of the fourth capacitor Ca4 is coupled to the fourth node N4, and a second end of the fourth capacitor Ca4 is coupled to Vss. Also, the gate turn-off voltage Voff is outputted via the fourth node N4.

The second charge pump circuit 412*a* receives the first pulse P1 and the second reference voltage Vref2 to perform a negative charge pump on the first pulse P1 and the second reference voltage Vref2 so as to output the gate turn-off voltage Voff. An amplitude of the second reference voltage Vref2 decreases when the peripheral temperature increases, and the amplitude of the second reference voltage Vref2 increases when the peripheral temperature decreases. In addition, the second reference voltage Vref2 may have a ground potential or negative voltage level (see FIG. 11.).

As illustrated in FIG. 11, when the first pulse P1 is provided to the second voltage generator 412, the third node N3 of the second voltage generator 412 outputs the fourth pulse P4. The fourth pulse P4 has the second reference voltage Vref2 level when the first pulse P1 has a high voltage level, and has a voltage level lower than the second reference voltage Vref2 by the first amplitude ΔV1 of the first pulse P1 when the first pulse P1 has a low voltage level.

The fourth pulse P4 is clamped by the fourth diode Di4 and capacitor Ca4 and is outputted as the gate turn-off voltage Voff via the fourth node N4. The gate turn-off voltage Voff has a DC voltage lower than the second reference voltage Vref2 by the first amplitude ΔV1 of the first pulse P1.

That is, the magnitude of the gate turn-off voltage Voff may be varied in accordance with the change of the amplitude of the first pulse P1 when the peripheral temperature is changed.

Referring back to FIGS. 6 and 11, the switching circuit 430 outputs the second pulse P2 i.e. a clock signal CLK1 or CLK having a predetermined period. In addition, the clock signal CLK1 or CLK swings between the gate turn-on voltage Von and the gate turn-off voltage Voff. The gate turn-on voltage Von is a positive DC voltage of which voltage level increases when the peripheral temperature decreases, and the voltage level of the gate turn-on voltage Von decreases when the peripheral temperature increases. In addition, the gate turn-off voltage Voff is a negative DC voltage of which voltage level decreases when the peripheral temperature decreases, and the voltage level of the gate turn-off voltage Voff increases when the peripheral temperature increases.

Accordingly, the second pulse P2 outputted from the pulse compensator 400 swings between the gate turn-on voltage Von and the gate turn-off voltage Voff, as a result, the amplitude of the second pulse P2 increases when the peripheral temperature decreases, and the amplitude of the second pulse P2 decreases when the peripheral temperature increases.

In other words, as illustrated in FIG. 11, the second amplitude ΔV2 of the second pulse P2 is higher than the first amplitude ΔV1 of the first pulse P1.

Further, the switching circuit 410 may employ a control device such as a timing controller for performing the switching operation as described above.

Hereinbefore, the process in which the pulse compensator converts the first pulse P1 into the second pulse P2 to increase the amplitude of the second pulse P2 when the peripheral temperature becomes lower than a reference temperature, was explained. However, the amplitude of the second pulse P2 may decrease when the peripheral temperature becomes higher than the reference temperature.

The amplitude of the first reference voltage Vref1 and/or the first pulse P1 provided to the first and second voltage generators 411 and 412 are controlled by controlling the amplitude of the second pulse P2.

In other words, according as the peripheral temperature is gradually decreased to be lower than the reference temperature, the amplitude of the first reference voltage Vref1 or the first pulse P1 is gradually increased.

On the other hand, according as the peripheral temperature is gradually increased to be higher than the reference temperature, the first reference voltage Vref1 or the first pulse P1 is gradually decreased. Therefore, according to the peripheral temperature, the amplitude of the second pulse P2 may be adequately controlled.

Further, the amplitude of the second pulse P2 may be controlled to vary according to the peripheral temperature by controlling the second reference voltage Vref2 instead of the first reference voltage Vref1 and/or the first pulse P1.

Figure 8:
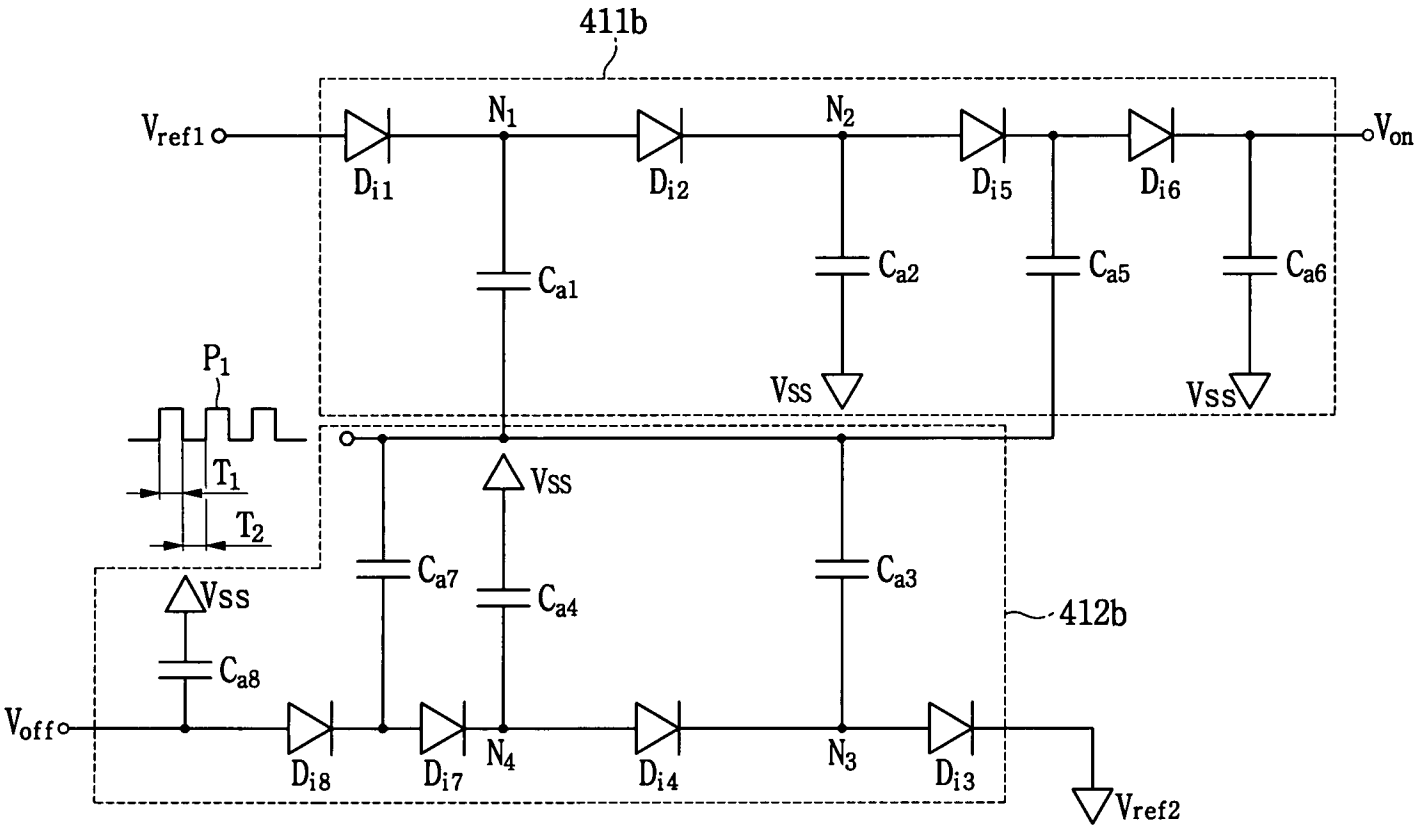
FIG. 8 is a circuit diagram illustrating the first and second voltage generators of FIG. 6 that are implemented as another charge pump circuit according to another exemplary embodiment of the present invention.

FIG. 8 is a circuit diagram illustrating the first and second voltage generators of FIG. 6 that are implemented as another charge pump circuit according to another exemplary embodiment of the present invention.

Referring to FIG. 8, a first voltage generator 411 includes a third charge pump circuit 411*b*.

The third charge pump circuit 411*b* includes four diodes Di1, Di2, Di3 and Di4 and four capacitors Ca1, Ca2, Ca5 and Ca6. The capacitors Ca1 and Ca5 perform a charge-pump operation. For example, when a first reference voltage Vref1 has about 7.8 volt, a gate turn-on voltage Von is charge pumped twice by the capacitors Ca1 and Ca5 to have a DC voltage level higher than a first pulse P1 by about 15.6 volts. That is, the gate turn-on voltage Von has a value between about 20 volts and about 24 volts.

A second voltage generator 412 includes a negative charge pump circuit 412*b*. The negative charge pump circuit 412*b* includes four diodes Di3, Di4, Di7 and Di8 and four capacitors Ca3, Ca4, Ca7 and Ca8. The capacitors Ca3 and Ca7 perform a negative charge pump operation. For example, when a second reference voltage Vref2 has about 0 volt, a gate turn-off voltage Voff is negative charge pumped twice by the capacitors Ca3 and Ca7 to have a DC voltage level lower than the amplitude of the first pulse P1 by 15.6 volts. That is, the gate turn-off voltage Voff has a value between about −13 volts and about −16 volts.

Hereinafter, the process of controlling the first reference voltage Vref1 according to the peripheral temperature will be described.

FIG. 9 is a circuit diagram illustrating a circuit for generating a first pulse P1 based on variation of peripheral temperature.

Referring to FIG. 9, a feedback voltage Vf is generated by a feedback circuit 920 according to the variation of the peripheral temperature, the feedback voltage Vf is provided to the PWM signal generator 910. Further, the PWM signal generator 910 may be implemented using a PWM IC used for a DC/DC converter.

The feedback circuit 920 includes a voltage divider such as resistors R1 and R2, a capacitor C1, three PN-junction diodes D1, D2 and D3, a resistor R3 parallelly connected to the three PN-junction diodes D1, D2 and D3, and a resistor R4 for cutting off a leakage current.

The PWM signal generator 910 receives a DC voltage VIN from a VIN input terminal connected to Vss through the capacitor C2, and generates the first pulse P1.

The amplitude of the first pulse P1 outputted from the PWM signal generator 910 may be determined by the ratio of R1:R2.

A voltage of a node N5 obtained by performing a voltage division on the resistors R1 and R2 may be controlled so that the feedback voltage Vf has an internal reference voltage (for example, about +1.25 volts) of the PWM signal generator 910.

The voltage of node N5 passes through N PN-junction diodes and is provided to the PWM signal generator 910 as the feedback voltage (Vf, a voltage of node N6). For example, in FIG. 9, n is equal to 3.

The feedback voltage Vf is a DC voltage and is defined by a following Expression 1.

$$Vf=\Delta V1\times R2\div(R1+R2)-N\times VD(T) \quad \text{<Expression 1>}$$

, wherein ΔV1 denotes an amplitude of the first pulse P1, N denotes a number of diodes, VD(T) denotes a threshold voltage of a diode according to the variation of a peripheral temperature.

Generally, a threshold voltage of a PN-junction diode is −2 mV/° C.

According to Expression 1, when the peripheral temperature decreases, the feedback voltage Vf decreases, simultaneously when the feedback voltage Vf decreases, the amplitude of the first pulse P1 outputted from the PWM signal generator 910 increases.

Figure 10:
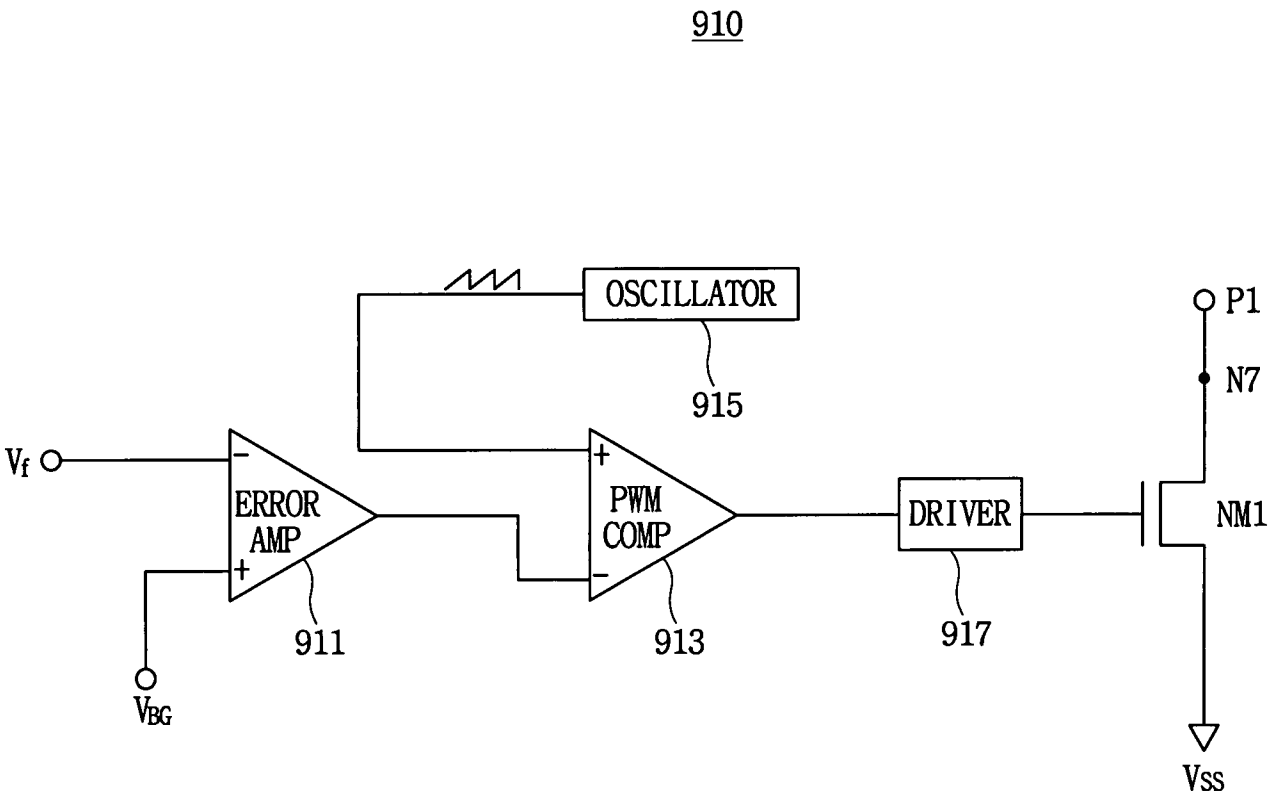
FIG. 10 is a schematic block diagram illustrating the PWM signal generator shown in FIG. 9.

Referring to FIG. 10, an error amplifier 911 compares the feedback voltage Vf with a band-gap voltage Vbg.

When the peripheral temperature decreases lower than the reference temperature and the feedback voltage Vf is lower than the band-gap voltage Vbg, the error amplifier 911 outputs a high level voltage. When the peripheral temperature increases higher than the reference temperature and the feed voltage Vf is higher than the band-gap voltage Vbg, the error amplifier 911 outputs a low level voltage.

The PWM comparator 913 receives a triangular wave outputted from an oscillator 915 and an output signal of the error amplifier 911 to output a PWM signal.

When the error amplifier 911 outputs a high level voltage, the PWM comparator 913 increases a duty ratio D of the PWM signal, and when the error amplifier 911 outputs a low level voltage, the PWM comparator 913 decreases the duty ratio D of the PWM signal.

A driver 917 amplifies an output current outputted from the PWM comparator 913 and provides the amplified output current to a gate electrode of a NMOS transistor NM1.

When the NMOS transistor NM1 is turned-on, reverse bias voltage is applied to the diode D4 of FIG. 9, the diode D4 is turned-off, and an inductor L1 of FIG. 9 is charged with electromagnetic energy. Here, the first pulse P1 has a voltage level of Vss.

When the NMOS transistor NM1 is turned-off, a forward bias voltage is applied to the diode D4 of FIG. 9, the diode D4 is turned-on, and the electromagnetic energy charged in the inductor L1 of FIG. 9 is transferred to the terminal Vref1. In this case, the first pulse P1 has a value of Vref 1+VD4. VD4 represents a voltage difference between an anode and a cathode of the diode D4 when the forward bias voltage is applied to the diode D4.

When the peripheral temperature becomes lower than the reference temperature, the duty ratio of the PWM signal is increased, and the amplitude of the first pulse P1 is increased since the electromagnetic energy charged in the inductor L1 of FIG. 9 is increased.

Figure 12:
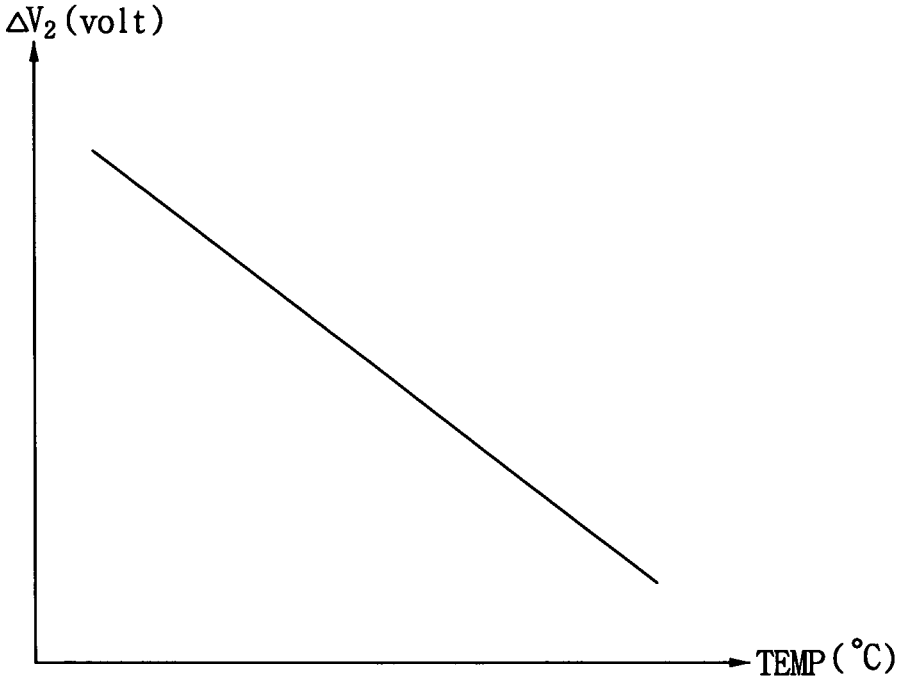
FIG. 12 is a graph illustrating the ideal relation between amplitude of a second pulse outputted from the pulse compensator shown in FIG. 1 and the peripheral temperature.
Figure 13:
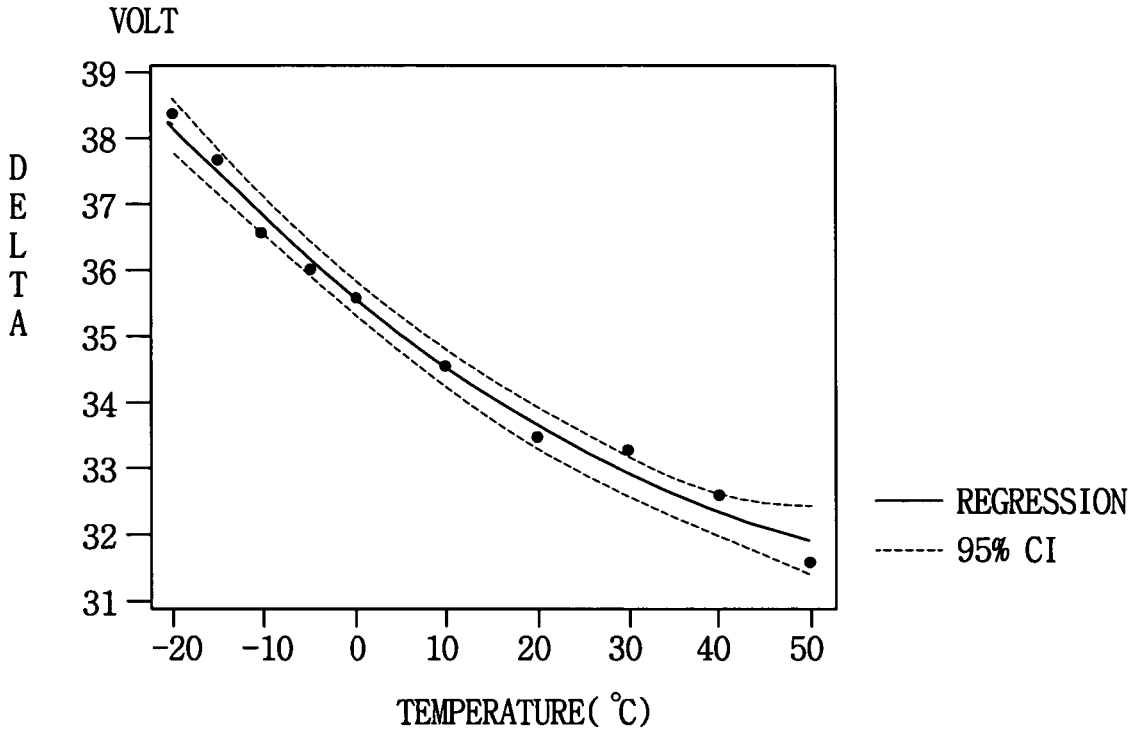
FIG. 13 is a graph illustrating a simulation result of the relation between amplitude of the second pulse outputted from the pulse compensator using the charge pump circuit shown in FIG. 8 and the peripheral temperature.

FIG. 12 is a graph illustrating the ideal relation between amplitude of a second pulse outputted from the pulse compensator shown in FIG. 1 and the peripheral temperature, and FIG. 13 is a graph illustrating a simulation result of the relation between amplitude of the second pulse outputted from the pulse compensator using the charge pump circuit shown in FIG. 8 and the peripheral temperature.

As illustrated in FIGS. 6 and 12, the pulse compensator 400 outputs the second pulse P2 having a swing width of the second amplitude ΔV2 higher than the first amplitude (ΔV1, shown in FIG. 11) of the inputted first pulse P1 when the peripheral temperature becomes lower than the reference temperatures.

However, the pulse compensator 400 outputs the second pulse P2 having a swinging width of the second amplitude ΔV2 lower than the first amplitude ΔV1 of the first pulse P1 when the peripheral temperature becomes higher than the reference temperature.

Referring to FIG. 13, when the peripheral temperature is −20° C., −15° C., −10° C., −5° C., 0° C., 10° C., 20° C., 30° C., 40° C. and 50° C., the amplitudes of the second pulse P2 are illustrated. For example, when the peripheral temperature is at 20° C., the amplitude (ΔV2; DELTA) of the second pulse P2 is similar to the amplitude at 33° C. to 34° C. When the peripheral temperature increases, the amplitude (ΔV2; DELTA) of the second pulse P2 decreases, and when the peripheral temperature decreases, the amplitude (ΔV2; DELTA) of the second pulse P2 increases.

In FIG. 13, a solid line represents a regression curve and a dotted line represents a 95% confidence interval (CI).

Although the TFT gate voltage of each of the stages in the gate driver (420, shown in FIG. 1) is varied proportionally to the peripheral temperature, the amplitude of the second pulse P2 (i.e. the first or second clock CKV or CKVB) provided from the pulse compensator 400 is decreased when the peripheral temperature increases, and the amplitude of the second pulse P2 is increased when the peripheral temperature decreases. Consequently, the TFT gate voltage of each of the stages is compensated according to the variation of the peripheral temperature.

In other words, the pulse compensator (400, shown in FIG. 1) decreases the amplitude of the first or the second clock CKV or CKVB when the peripheral temperature increases, and the pulse compensator 400 increases the amplitude of the first or the second clock CKV or CKVB when the peripheral temperature decreases.

Particularly, the pulse compensator 400 increases the amplitude of the first or the second clock CKV or CKVB when the peripheral temperature becomes lower than the reference temperature, therefore, the deterioration of the drive capability of the gate driver depending on the peripheral temperature may be prevented.

According to above described display device, when the peripheral temperature becomes lower than the reference temperature, the pulse compensator increases the amplitude of the second pulse provided to the gate driver.

As a result, the deterioration in the drive capability of the gate driver depending on the peripheral temperature may be prevented, and display quality of the display device may be improved.

This invention has been described with reference to the exemplary embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A display device comprising:

a pulse compensator configured to generate a clock signal which comprises high and low voltage levels;

a gate driver including an amorphous silicon thin film transistor and configured to generate a gate driving signal based on the clock signal;

a source driver configured to output a data signal; and a display panel configured to display an image corresponding to the data signal in response to the gate driving signal, wherein at least one of the high and low voltage levels varies depending on a peripheral temperature to compensate for a current variation of the amorphous silicon thin film transistor depending on the peripheral temperature, wherein the pulse compensator comprises:

a first voltage generator configured to generate a first DC voltage;

a second voltage generator configured to generate a second DC voltage; and a switching circuit coupled to the first and second voltage generators and configured to generate the clock signal by swinging between the first DC voltage and the second DC voltage, the clock signal having a greater amplitude than a first pulse provided to the pulse compensator when the peripheral temperature becomes lower than a reference temperature and having a smaller amplitude than the first pulse when the peripheral temperature becomes higher than the reference temperature, wherein the first voltage generator comprises a first diode connected to a first reference voltage, a second diode connected to the first diode in series, and a first capacitor having a first electrode connected to a node between the first diode and the second diode and a second electrode connected to a pulse line to which the first pulse is applied, and wherein the second voltage generator comprises a third diode connected to a second reference voltage, a fourth diode connected to the third diode in series, and a second capacitor having a first electrode connected to a node between the third diode and the fourth diode and a second electrode connected to the pulse line to which the first pulse is applied.

2. The display device of claim 1, wherein the gate driver comprises a shift register, which includes a plurality of stages, configured to output the gate driving signal when the clock signal has the high voltage level.

3. The display device of claim 2, wherein each of the stages is configured to receive the clock signal via a first current electrode of the amorphous silicon thin film transistor to provide the clock signal as the gate driving signal when the amorphous silicon thin film transistor is turned-on.

4. The display device of claim 3, wherein at least one of the stages comprises a transistor receiving a gate signal of one of previous stages through an output of said one of previous stages thereby charging a capacitor to output a gate signal of a present stage.

5. The display device of claim 3, wherein at least one of the stages comprises a transistor receiving a gate signal of one of next stages through an output of said one of next stages to discharge a capacitor.

6. The display device of claim 3, wherein at least one of the stages comprises a transistor turned on by a gate signal of one of next stages through an output of said one of next stages to pull down a gate signal of a present stage.

7. The display device of claim 6, wherein the gate signal of the present stage is pull down to a first power supply voltage level, which is varied depending on a peripheral temperature variation.

8. The display device of claim 1, wherein a voltage level of the first pulse decreases when the peripheral temperature becomes higher than the reference temperature, and the voltage level of the first pulse increases when the peripheral temperature becomes lower than the reference temperature.

9. The display device of claim 1, wherein the first reference voltage increases when the peripheral temperature becomes higher than the reference temperature, and the first reference voltage decreases when the peripheral temperature becomes lower than the reference temperature.

10. The display device of claim 1, wherein the first voltage generator performs a charge-pump operation on the first pulse using the first reference voltage to generate the first DC voltage.

11. The display device of claim 1, wherein the second voltage generator performs a negative charge-pump operation on the first pulse using the second reference voltage to generate the second DC voltage.

12. The display device of claim 1, the pulse compensator further comprises:

a feedback circuit configured to generate a feedback voltage, wherein a level of the feedback voltage decreases when peripheral temperature increases and the level of the feedback voltage increases when peripheral temperature decreases;

a pulse width modulation signal generator configured to perform a pulse width modulation to generate the first pulse, an amplitude of the first pulse increasing according as the feedback voltage decreases; and a second pulse generator generating the clock signal using the first pulse, wherein an amplitude of the clock signal decreases when the peripheral temperature increases and the amplitude of the clock signal increases when the peripheral temperature decreases.

13. The display device of claim 12, wherein the feedback circuit generates the feedback voltage using at least one diode having a threshold voltage substantially inversely proportional to the peripheral temperature.

14. The display device of claim 1, wherein the display panel comprises a plurality of gate lines and a plurality of data lines, and the gate driver outputs the gate driving signal to the gate lines.

15. The display device of claim 1, wherein the clock signal comprises a first clock signal and a second clock signal, and a phase of the first clock signal is different from a phase of the second clock signal.

16. The display device of claim 15, wherein the gate driver comprises a shift register, which includes a first stage group and a second stage group, the first stage group configured to output the gate driving signal when the first clock signal has the high voltage level and the second stage group configured to output the gate driving signal when the second clock signal has the high voltage level.

17. A display device comprising:

a pulse generator comprising:

a first voltage generator configured to generate a first DC voltage having a voltage level higher than that of a first pulse by a first reference voltage when a peripheral temperature becomes lower than a reference temperature;

a second voltage generator configured to generate a second DC voltage having a voltage level lower than that of the first pulse by a second reference voltage when the peripheral temperature becomes lower than the reference temperature; and a switching circuit coupled to the first and second voltage generators and configured to generate a clock signal, a gate driver including an amorphous silicon thin film transistor configured to generate a gate driving signal based on the clock signal;

a source driver configured to provide a gray-scale voltage based on a gray-scale data; and a display panel configured to display an image corresponding to the gray-scale voltage in response to the gate driving signal, wherein the clock signal swings between the first DC voltage and the second DC voltage to compensate for a current variation of the amorphous silicon thin film transistor depending on the peripheral temperature, wherein the first voltage generator comprises a first diode connected to the first reference voltage, a second diode connected to the first diode in series, and a first capacitor having a first electrode connected to a node between the first diode and the second diode and a second electrode connected to a pulse line to which the first pulse is applied, wherein the second voltage generator comprises a third diode connected to the second reference voltage, a fourth diode connected to the third diode in series, and a second capacitor having a first electrode connected to a node between the third diode and the fourth diode and a second electrode connected to the pulse line to which the first pulse is applied.

18. A display device comprising:

a pulse compensator comprising:

a feedback circuit configured to generate a feedback voltage, wherein a level of the feedback voltage decreases when peripheral temperature increases and the level of the feedback voltage increases when peripheral temperature decreases;

a pulse width modulation signal generator configured to perform a pulse width modulation to generate a first pulse, an amplitude of the first pulse increasing according as the feedback voltage decreases; and a second pulse generator generating a clock signal using the first pulse, a gate driver including an amorphous silicon thin film transistor configured to generate a gate driving signal based on the clock signal;

a source driver configured to provide a gray-scale voltage based on a gray-scale data; and a display panel configured to display an image corresponding to the gray-scale voltage in response to the gate driving signal, wherein an amplitude of the clock signal decreases when the peripheral temperature increases and the amplitude of the clock signal increases when the peripheral temperature decreases to compensate for a current variation of the amorphous silicon thin film transistor depending on the peripheral temperature, wherein the pulse compensator further comprises:

a first voltage generator configured to generate a first DC voltage;

a second voltage generator configured to generate a second DC voltage; and a switching circuit coupled to the first and second voltage generators and configured to generate the clock signal by swinging between the first DC voltage and the second DC voltage, the clock signal having a greater amplitude than a first pulse provided to the pulse compensator when the peripheral temperature becomes lower than a reference temperature and having a smaller amplitude than the first pulse when the peripheral temperature becomes higher than the reference temperature, wherein the first voltage generator comprises a first diode connected to a first reference voltage, a second diode connected to the first diode in series, and a first capacitor having a first electrode connected to a node between the first diode and the second diode and a second electrode connected to a pulse line to which the first pulse is applied, wherein the second voltage generator comprises a third diode connected to a second reference voltage, a fourth diode connected to the third diode in series, and a second capacitor having a first electrode connected to a node between the third diode and the fourth diode and a second electrode connected to the pulse line to which the first pulse is applied.

* * * * *